US011179933B2

(12) United States Patent
Vandenberghe et al.

(10) Patent No.: US 11,179,933 B2
(45) Date of Patent: Nov. 23, 2021

(54) PRINTHEAD DIE ASSEMBLY

(71) Applicant: HP SCITEX LTD., Netanya (IL)

(72) Inventors: Ken Vandenberghe, Corvallis, OR (US); Alon Navon, Azour (IL); Ronny Tuttnauer, Netanya (IL)

(73) Assignee: HP SCITEX LTD., Netanya (IL)

( * ) Notice: Subject to any disclaimer, the term of this patent is extended or adjusted under 35 U.S.C. 154(b) by 0 days.

(21) Appl. No.: 16/684,670

(22) Filed: Nov. 15, 2019

(65) Prior Publication Data

US 2020/0079082 A1 Mar. 12, 2020

Related U.S. Application Data

(62) Division of application No. 15/514,577, filed as application No. PCT/US2014/059335 on Oct. 6, 2014, now abandoned.

(51) Int. Cl.

| | |
|---|---|
| ***B41J 2/14*** | (2006.01) |
| ***B41J 25/34*** | (2006.01) |
| ***B41J 2/16*** | (2006.01) |
| ***B41J 2/045*** | (2006.01) |
| ***B41J 25/00*** | (2006.01) |

(52) U.S. Cl.

CPC ..... *B41J 2/14* (2013.01); *B41J 2/04505* (2013.01); *B41J 2/04506* (2013.01); *B41J 2/04581* (2013.01); *B41J 2/14201* (2013.01); *B41J 2/1604* (2013.01); *B41J 25/001* (2013.01); *B41J 25/34* (2013.01); *B41J 2002/14379* (2013.01); *B41J 2202/19* (2013.01)

(58) Field of Classification Search

None

See application file for complete search history.

(56) References Cited

U.S. PATENT DOCUMENTS

| | | | | |
|---|---|---|---|---|
| 5,198,054 | A | 3/1993 | Drake | |
| 5,734,394 | A * | 3/1998 | Hackleman | B41J 2/155 347/42 |
| 6,260,951 | B1 | 7/2001 | Harvey | |
| 6,286,942 | B1 * | 9/2001 | Miyazawa | B41J 2/14274 347/68 |
| 6,375,310 | B1 * | 4/2002 | Arakawa | B41J 2/14233 347/54 |
| 6,742,883 | B1 | 6/2004 | Takata | |
| 7,942,497 | B1 | 5/2011 | Matsumoto | |
| 8,517,508 | B2 | 8/2013 | Amiddon, Jr. | |

(Continued)

FOREIGN PATENT DOCUMENTS

| | | |
|---|---|---|
| CN | 10340277 | 11/2013 |
| CN | 103442894 A | 12/2013 |

(Continued)

OTHER PUBLICATIONS

Das, Ruma et al. Software Selection based on Quantitative Security Risk Assessment. CIIS2012.

(Continued)

*Primary Examiner* — Shelby L Fidler

(74) *Attorney, Agent, or Firm* — Dierker & Kavanaugh PC

(57) ABSTRACT

A method may include positioning first and second printhead die within a die carrier, using a registration pin of the die carrier to align the first and second printhead die and fixing the position of the first and second printhead die within the die carrier.

6 Claims, 6 Drawing Sheets

(56) References Cited

U.S. PATENT DOCUMENTS

| | | | | |
|---|---|---|---|---|
| 8,539,586 | B2 | 9/2013 | Stephenson | |
| 9,434,162 | B2 * | 9/2016 | Miyata | B41J 2/14233 |
| 2002/0003559 | A1 | 1/2002 | Harajiri | |
| 2005/0062799 | A1 | 3/2005 | Kitahara et al. | |
| 2007/0019035 | A1 * | 1/2007 | Koseki | B41J 2/145 347/54 |
| 2007/0070103 | A1 | 3/2007 | Akune | |
| 2010/0289854 | A1 * | 11/2010 | Hagiwara | B41J 2/155 347/44 |
| 2010/0302311 | A1 | 12/2010 | Blair et al. | |
| 2011/0148995 | A1 * | 6/2011 | Lee | B41J 2/14233 347/71 |
| 2011/0157275 | A1 | 6/2011 | Kubota | |
| 2011/0228002 | A1 | 9/2011 | Shepherd et al. | |
| 2013/0106954 | A1 | 5/2013 | Choy et al. | |
| 2013/0201256 | A1 | 8/2013 | Fricke et al. | |
| 2013/0325678 | A1 | 12/2013 | Cheng et al. | |
| 2014/0168319 | A1 * | 6/2014 | Moreau | B41J 2/04505 347/49 |
| 2014/0173737 | A1 | 6/2014 | Toback et al. | |
| 2016/0013159 | A1 | 1/2016 | Kwon | |

FOREIGN PATENT DOCUMENTS

| | | |
|---|---|---|
| JP | H11-165414 | 6/1999 |
| JP | 2001096753 | 4/2001 |
| JP | 2001310463 | 11/2001 |
| JP | 2001341298 | 12/2001 |
| JP | 2004-058277 | 2/2004 |
| JP | 2011-240526 | 12/2011 |
| WO | WO-2013176661 | 11/2013 |

OTHER PUBLICATIONS

United States General Accounting Office. Accounting and Information management Division. Information Security Risk Assessment. Nov. 1999.

* cited by examiner

PRINTHEAD DIE ASSEMBLY

CROSS-REFERENCE TO RELATED APPLICATIONS

The present application is a divisional application claiming priority from co-pending U.S. patent application Ser. No. 15/514,577 filed on Mar. 27, 2017 by Vandenberghe et al. and entitled PRINTHEAD DIE ASSEMBLY, which is a 371 patent application from PCT/US2014/059335 filed on Oct. 6, 2014 by Vandenberghe et al. and entitled PRINTHEAD DIE ASSEMBLY, the full disclosures of which are hereby incorporated by reference.

BACKGROUND

Current piezoelectric printheads manufactured for use in commercial printers may utilize double-sided silicon die in order to provide multiple ink drop weights and high nozzle densities. The double-sided die are manufactured by using a photolithographic and etch process to build piezoelectric actuator circuits and fluidic channels for ink dispensing devices on both sides of a silicon wafer. The wafer is then separated into individual double-sided die. The devices manufactured on one side of the silicon wafer must be protected while devices are manufactured on the other side of the silicon wafer, resulting in increased complexity of the manufacturing process and lower yields from each silicon wafer.

DETAILED DESCRIPTION OF EXAMPLES

Figure 1A:
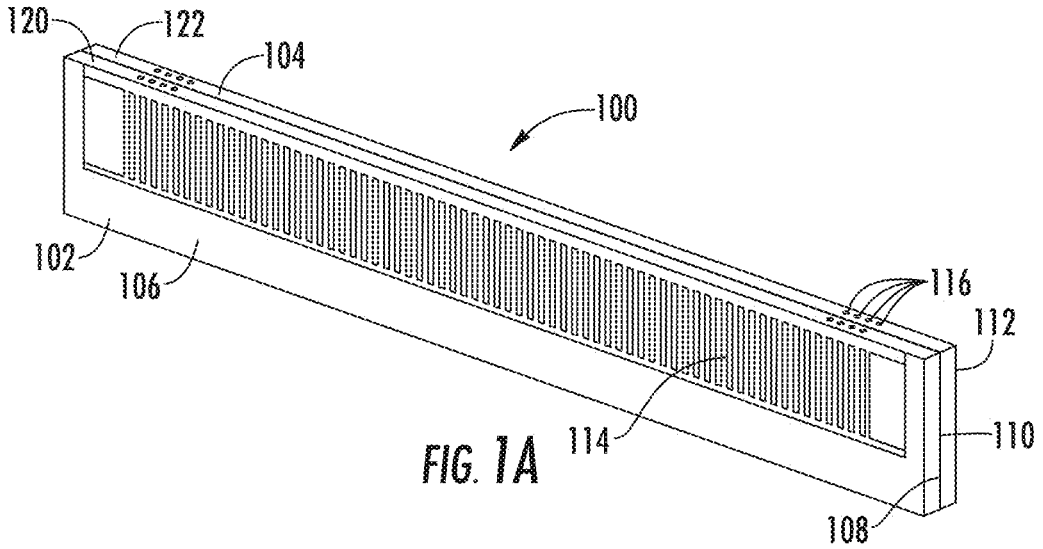
FIG. 1A is a perspective view illustrating an example printhead die assembly.
Figure 1B:
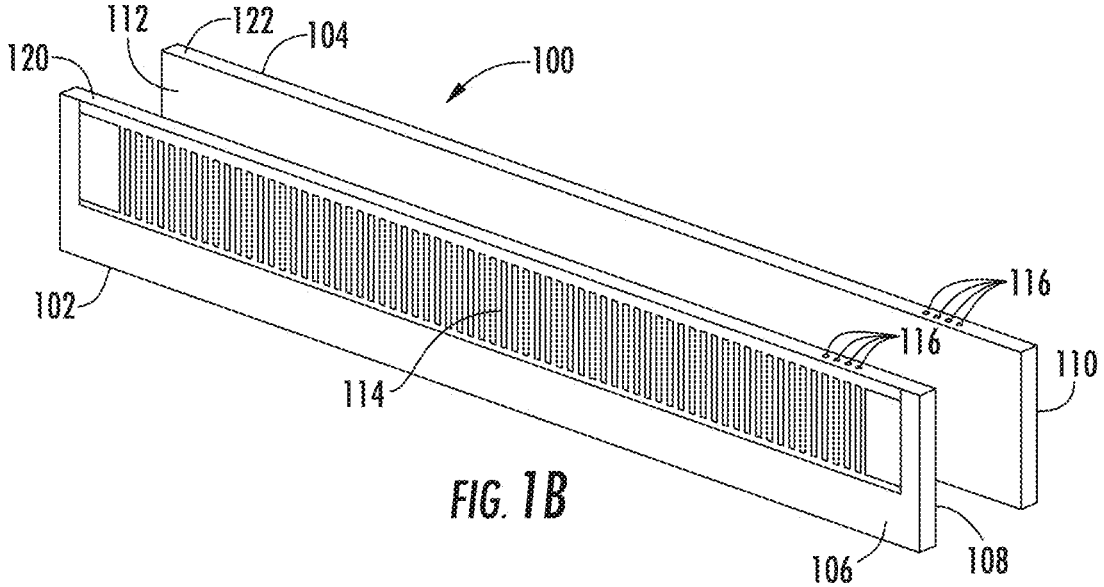
FIG. 1B is an exploded view illustrating the printhead die assembly of FIG. 1A.
Figure 1C:
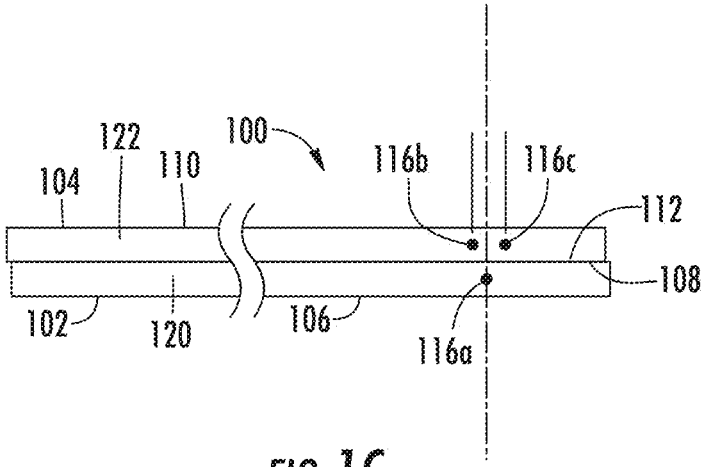
FIG. 1C is a top plan view illustrating the printhead die assembly of FIG. 1A.

FIGS. 1A, 1B, and 1C illustrate an example printhead die assembly 100. FIG. 1A is a perspective view of printhead die assembly 100. FIG. 1B is an exploded view of printhead die assembly 100. FIG. 1C is a top plan view of printhead die assembly 100. Printhead die assembly 100 may be, for example, a die assembly for use in a piezoelectric inkjet printhead similar to printheads used in commercial inkjet printers, such as the SCITEX FB10000 manufactured by Hewlett Packard Company, assignee of the present application. Printhead die assembly 100 may be used in other types of printheads and/or printers as well.

As shown in FIGS. 1A, 1B, and 1C, printhead die assembly 100 may include a die 102 and a die 104. Die 102 and die 104 are shown as rectangular in shape, but other shapes are contemplated as well, depending on the particular application. Example dimensions for rectangular die 102 and die 104 are 1.5 inches in length by 0.25 inches in width, but other dimensions and sizes are contemplated as well, depending on the particular application.

Die 102 and die 104 may be manufactured from, for example, a silicon wafer or another suitable material, depending on the particular application. For example, die 102 and die 104 may be individual die sections separated (e.g., by sawing or cutting) from an 8 inch diameter round silicon wafer having an industry standard thickness of approximately 757 microns. If example dimensions of 1.5 inches in length by 0.25 inches in width are used for each die, then approximately 96 die may be cut from a single 8 inch diameter silicon wafer. Other wafer sizes and thicknesses are contemplated as well, depending on the particular application.

Die 102 may have a surface 106 and an opposite surface 108. Similarly, die 104 may have a surface 110 and an opposite surface 112. As illustrated in FIGS. 1A and 1B, surface 106 of die 102 and surface 110 of die 104 may have ink dispensing devices 114 constructed thereon. Ink dispensing devices 114 may include, for example, fluid chambers and piezoelectric actuators for dispensing ink through nozzles 116.

Ink dispensing devices 114 may be constructed on surfaces 106 and 110 using, for example, a photolithographic process that uses a combination of masking, depositing, and etching steps in order to form electrical circuits, fluidic channels, and other structures that make up the ink dispensing devices 114 for each die on the front surface of a silicon wafer. Individual die, such as die 102 and die 104, may then be separated from the other die on the silicon wafer. By way of example, if dimensions of 1.5 inches in length by 0.25 inches in width are used for each die, then approximately 96 die may be cut from a single 8 inch diameter, 757 micron silicon wafer, where each die includes 96 ink dispensing devices 116 each having a corresponding nozzle 116. Other manufacturing processes may be used as well to create ink dispensing devices 114 depending on the particular application. Similarly, die having differing types, numbers, and sizes of ink dispensing devices 114 and nozzles 116 are contemplated as well, depending on the particular application.

As illustrated in FIGS. 1A and 1B, die 102 and die 104 may be positioned adjacent to each other. In particular, die 102 and die 104 may be positioned so that surface 108 of die 102 faces surface 112 of die 104. In some examples, die 102 and die 104 may be positioned so that a surface 120 of die 102 containing openings for nozzles 116 may be approximately flush with a surface 122 of die 104 that also contains openings for nozzles 116. In some examples, a layer of adhesive may be applied between die 102 and die 104. For example, an ultraviolet (UV) curing adhesive may be applied to one or both of surfaces 108 and 112 to hold die 102 and die 104 in positions adjacent to each other when surfaces 108 and 112 are mated. Once die 102 and 104 are positioned and aligned as desired, the layer of adhesive may be exposed to UV illumination in order to set the adhesive and fix die 102 and die 104 in position.

FIG. 1C is top plan view of printhead die assembly 100 that illustrates an example positioning of die 102 with respect to die 104. As illustrated in FIG. 1C, die 102 and die 104 may be positioned so that nozzles 116 of die 102 are aligned relative to nozzles 116 of die 104. In particular, a nozzle 116*a* of die 102 is shown as being centered with respect to nozzles 116*b* and 116*c* of die 104. While the example illustrated in FIG. 1C shows a centered alignment, other alignments or offsets are contemplated as well, depending on the particular application. In some examples, nozzles 116*a*, 116*b*, and 116*c* may be aligned with respect to each other with an accuracy of approximately 5 microns.

As illustrated in FIGS. 1A and 1B, die 102 and die 104 may be-single sided die, as opposed to double-sided die. Die 102 and die 104 are single sided die in the sense that they include electrical circuits, fluidic channels, and other structures that make up the ink dispensing devices 114 on only one of surfaces 106 and 108 with respect to die 102, and on only one of surfaces 110 and 112 with respect to die 104. That is, as best shown in FIG. 1B, die 102 may include ink dispensing devices 114 constructed on surface 106, but not on opposite surface 110, and die 104 may include ink dispensing devices 114 constructed on surface 110, but not on opposite surface 112. Using two single-sided die in die assembly 102 allows for multiple drop weights, high nozzle density, low crosstalk, and higher reliability.

Using two single-sided die in die assembly 100 as opposed to one double-sided die also eliminates the need to construct ink dispensing devices 114 on both sides of a die found on a double-sided printhead die. Constructing ink dispensing devices on both sides of a die requires that the devices manufactured on one side of, for example, a silicon wafer be protected while ink dispensing devices are manufactured on the other side of the silicon wafer. For example, where photolithographic processes are used, a sacrificial layer is often used to protect devices formed on one side of the silicon wafer while devices are constructed on the opposite side, resulting in increased complexity of the photolithographic device construction process. This process can also lead to a large number of device defects, lower die yields from each silicon wafer, increased manufacturing variation, and poor image quality. Using two single-sided die in die assembly 100 as opposed to one double-sided die may eliminate the need for such a sacrificial layer, thus reducing the complexity of the photolithographic process. Using two single-sided die in die assembly 100 as opposed to one double-sided die also reduces number of defects associated with using a sacrificial layer for protection of devices formed on one side of the silicon wafer while devices are constructed on the opposite side, resulting in higher die yields, reduced manufacturing variation, and higher image quality. Using two single-sided die in die assembly 102 also allows for thinner wafers of industry standard thickness (e.g., 725 microns) to be used, as opposed to thicker non-standard wafers that are used in double-sided die (e.g., 1061 microns), which may provide material cost reductions and manufacturing efficiencies.

Figure 2A:
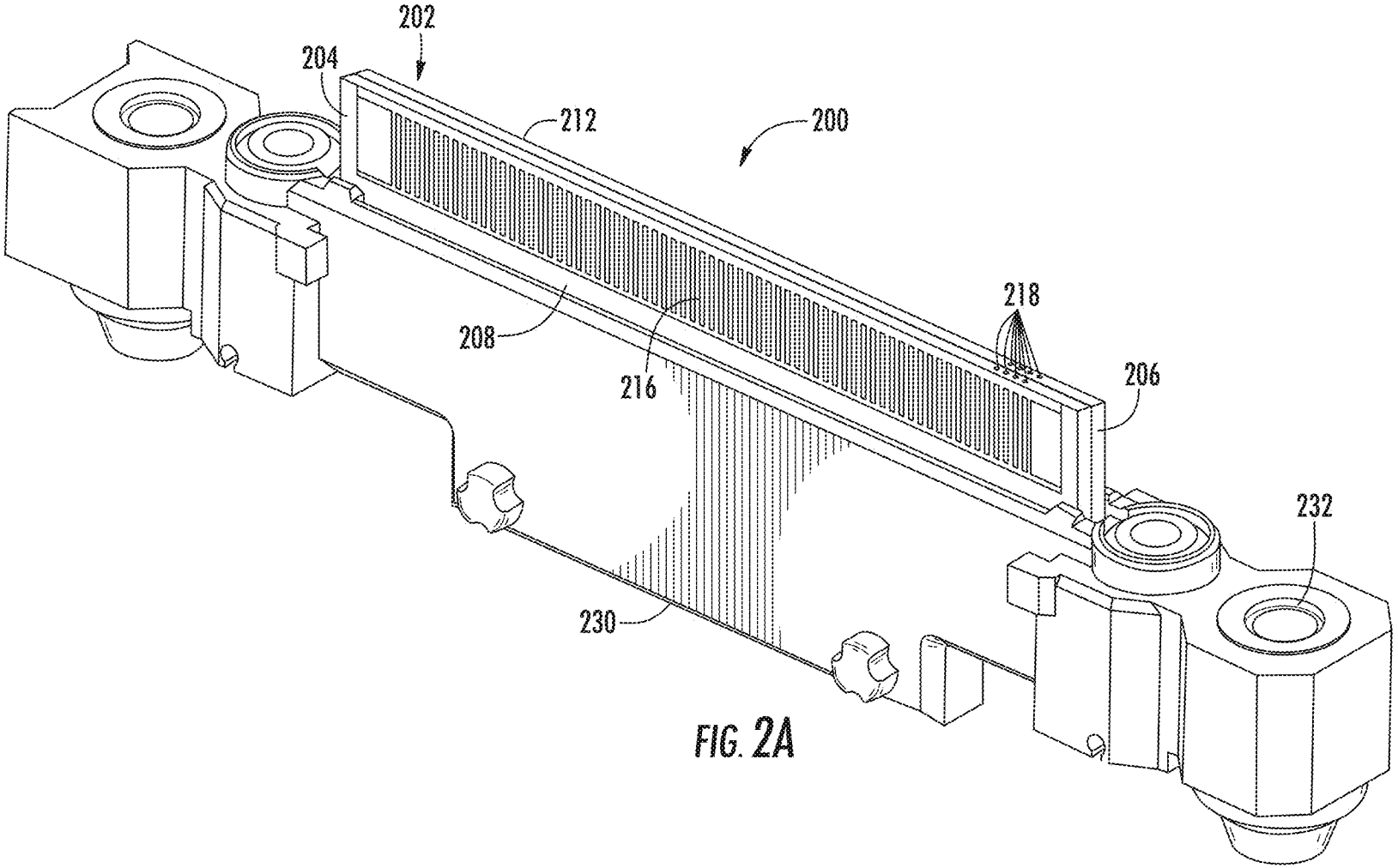
FIG. 2A is a perspective view of an example printhead including an example printhead die assembly similar to the printhead die assembly shown in FIG. 1A.
Figure 2B:
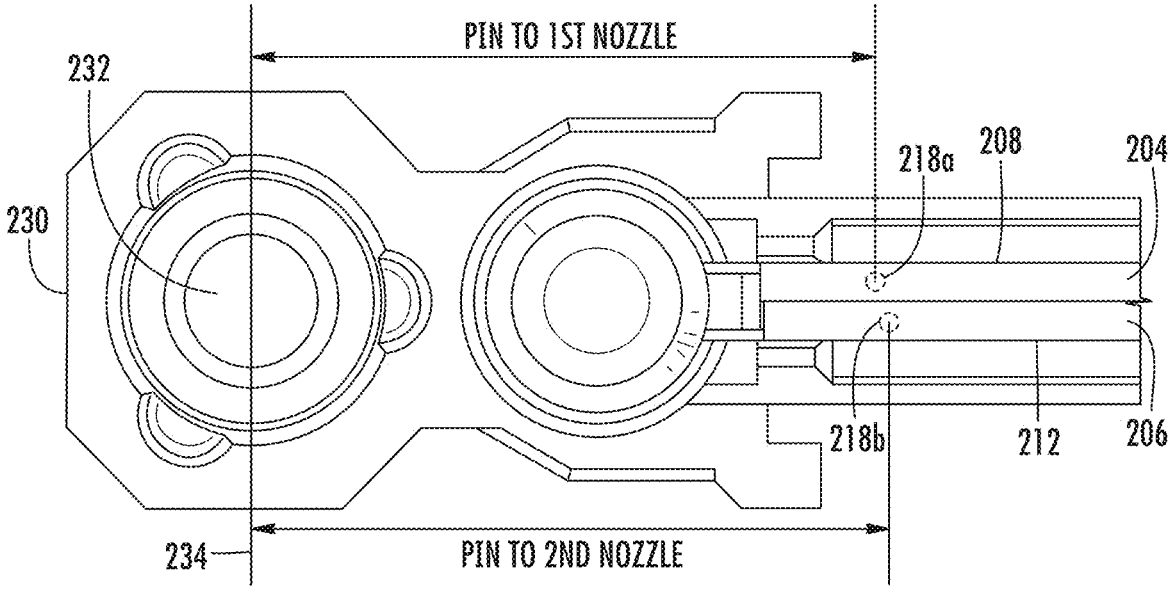
FIG. 2B is a bottom view of the printhead of FIG. 2A illustrating an example alignment of the printhead die assembly with a registration pin of a die carrier.

FIGS. 2A and 2B illustrate an example printhead assembly 200 including an example printhead die assembly 202. FIG. 2A is a perspective view of example printhead 200. FIG. 2B is a bottom view of the example printhead 200. Printhead 200 may be, for example, a piezoelectric inkjet printhead similar to printheads used in commercial inkjet printers, such as the SCITEX FB10000 manufactured by Hewlett Packard Company, assignee of the present application. Printhead 200 may also be designed for use in other types of printers as well.

Printhead die assembly 202 is similar to printhead die assembly 100 shown in FIG. 1A. For example, as shown in FIG. 2A, printhead die assembly 202 may include a die 204 and a die 206. Die 204 and die 206 are shown as rectangular in shape, but other shapes, dimensions and sizes are contemplated as well, depending on the particular application. Die 204 and die 206 may be manufactured from, for example, a silicon wafer or another suitable material, depending on the particular application. For example, die 102 and die 104 may be individual die sections separated (e.g., by sawing or cutting) from an 8 inch diameter round silicon wafer having an industry standard thickness of approximately 725 microns. A surface 208 of die 204 and a surface 212 of die 206 may each have ink dispensing devices 216 constructed thereon. Ink dispensing devices 216 may include, for example, fluid chambers and piezoelectric actuators for dispensing ink through nozzles 218.

As illustrated in FIGS. 2A and 2B, die 204 and die 206 may be positioned adjacent to each other. In particular, die 204 and die 206 may be positioned so that the surface of die 204 opposite surface 208 faces a surface of die 206 opposite surface 212. In some examples, a layer of adhesive may be applied between die 204 and die 206. In some examples, die 204 and die 206 may be positioned so that nozzles 218 of die 204 are aligned relative to nozzles 218 of die 206 (e.g., a centered alignment, other alignments or offsets) depending on the particular application. Die 204 and die 206 may be single sided die, as opposed to double-sided die.

Printhead 200 may also include a die carrier 230. Die carrier 230 may provide electrical and fluidic connections between printhead die assembly 202 and, for example, a commercial inkjet printer. Die carrier 230 may also provide structural support for printhead die assembly 202. For example, as shown in FIG. 2A, printhead die assembly 202 may be partially inserted into and seated within a cavity of die carrier 230 such that die 204 and die 206 are generally held in position, with portions of printhead die assembly extending outward from die carrier 230 such that nozzles 218 are exposed.

Die carrier 230 may include a registration pin 232. Registration pin 232 may be used to provide a reference point from which the position of printhead die assembly may be defined, such as for calibrating a printer in which printhead 230 is used. In particular, registration pin 230 may be used to align die 204 and die 206 within die carrier 230. For example, as shown in FIG. 2B, a nozzle 218*a* of die 204 and a nozzle 218*b* of die 206 may each be aligned with registration pin 232 based on a line 234 passing through the center of registration pin 232. The individual positions of die 204 and die 206 may be adjusted such that, for example, the centers of nozzles 218*a* and 218*b* are a particular distance from line 234. In some examples, nozzles 218*a* and 218*b* may be aligned with registration pin 232 with an accuracy of approximately 8 microns.

Figure 3:
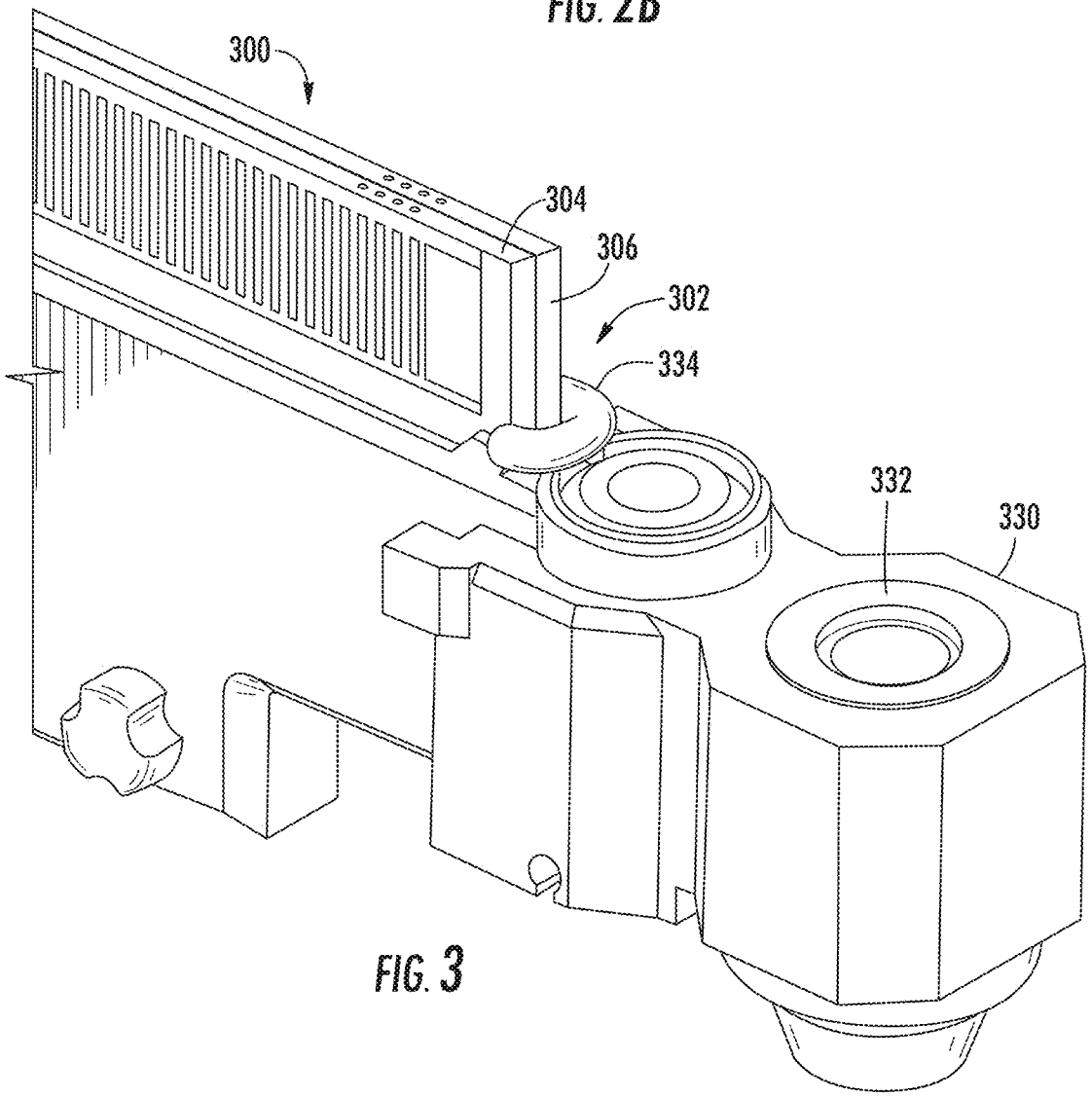
FIG. 3 is a perspective view of an example printhead similar to the printhead of FIG. 2A that illustrates an example of an adhesive used to fix the position of a printhead die assembly.

FIG. 3 is a perspective view of an example printhead 300 illustrating an example of how an adhesive may be used to fix the position of a printhead die assembly within a die carrier. Printhead 300 may be similar to, for example, printhead 200 shown in FIG. 2A. In particular, printhead 302 may include a printhead die assembly 302 that includes a die 304 and a die 306. Printhead 302 may also include a die carrier 330 and a registration pin 332. As shown in FIG. 3, an adhesive 334 may be applied such that it is in contact with die 304, die 306, and die carrier 330 to fix the position of die 304 and die 306 within die carrier 330. Adhesive 334 may be, for example, a UV adhesive or another suitable adhesive. In some examples, a UV adhesive may be applied as shown in FIG. 3 during or after alignment of die 304 and die 306 with registration pin 332, and may then be exposed to UV illumination in order to set adhesive 334 and fix the position of die 304 and die 306 within die carrier 330.

Figure 4:
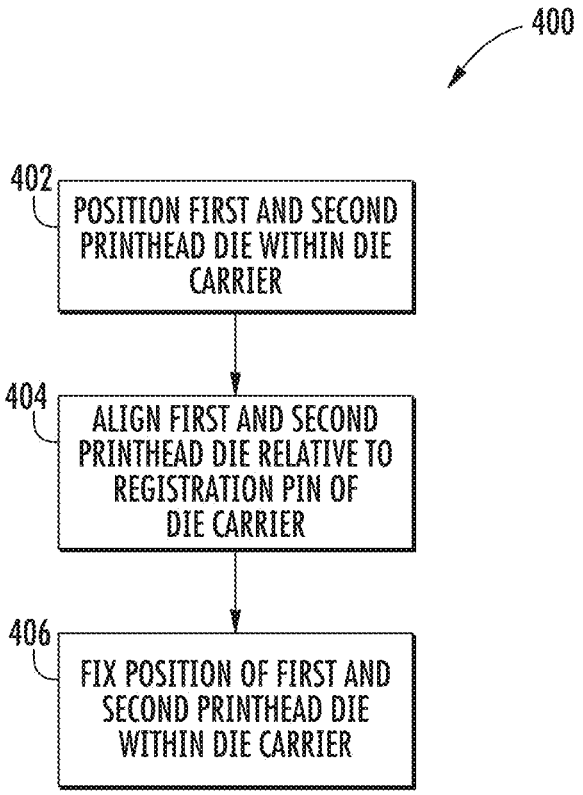
FIG. 4 is a flow diagram illustrating an example method of assembling a printhead.

FIG. 4 is a flow diagram illustrating an example method of assembling a printhead. The printhead may be, for example, printhead 200 shown in FIGS. 2A and 2B or printhead 300 shown in FIG. 3. For example, the printhead may include a printhead die assembly with two printhead die, and may also include a die carrier and a registration pin as described with reference to printhead 200 or printhead 300 and FIGS. 2A, 2B, and 3. As indicated by a step 402, each of the printhead die may be inserted into the die carrier.

As indicated by a step 404, each of the printhead die may be aligned relative to the registration pin of the die carrier. In some examples, a nozzle of each printhead die may be aligned with the registration pin. In some examples, a nozzle of each printhead die may each be aligned with the registration pin with an accuracy of approximately 8 microns. In some examples, nozzles of each of the printhead die may also be aligned relative to each other. In some examples, nozzles of each of the printhead die may also be aligned relative to each other with an accuracy of approximately 5 microns. In some examples, the desired level of accuracy may be achieved using a die alignment tool having two motorized stages coupled to micro grippers. The die alignment tool may utilize a real-time image processing and optics tool to acquire the position of each printhead die and control the movement of the motorized stages with a repeatability of less than 1 micron and an accuracy of not less than 1.5 microns.

As indicated by a step 406, the position of each of the printhead die may be fixed within the die carrier. For example, an adhesive may be applied such that it is in contact with each of the printhead die and the die carrier to fix the position of each printhead die within the die carrier. The adhesive may be, for example, a UV adhesive or another suitable adhesive. In some examples, a UV adhesive may be applied during or after alignment of each printhead die with the registration pin, and may then be exposed to UV illumination in order to set the adhesive and fix the position of each printhead die within the die carrier. In some examples, a layer of adhesive may be applied between the two printhead die. In some examples, a UV adhesive may also be applied between each of the printhead die prior to step 402 in order to hold each of the printhead die in positions adjacent to each other when mated together. Once each of the printhead die are positioned and aligned as desired, the layer of adhesive may be exposed to UV illumination in order to set the adhesive and fix each of the printhead die in position.

Figure 5:
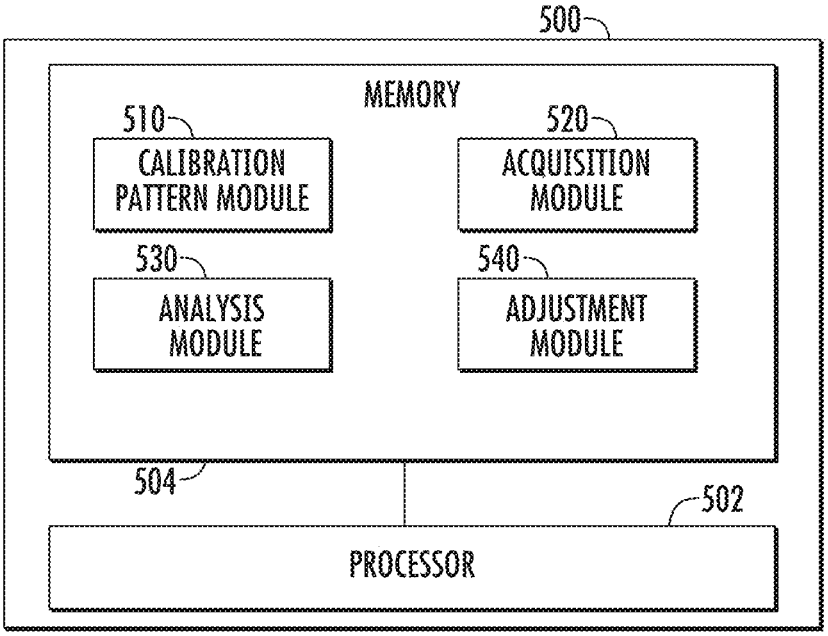
FIG. 5 is a block diagram illustrating an example system for calibrating a printhead.

FIG. 5 is a block diagram illustrating an example system 500 for calibrating a printhead. System 500 may be implemented in, for example, a commercial inkjet printer, such as the SCITEX FB10000 manufactured by Hewlett Packard Company, assignee of the present application, or may be a separate system or a combination thereof. The printhead may be, for example, printhead 200 shown in FIGS. 2A and 2B or printhead 300 shown in FIG. 3. For example, the printhead may include a printhead die assembly with two printhead die, and may also include a die carrier and a registration pin as described with reference to printhead 200 or printhead 300 and FIGS. 2A, 2B, and 3. System 500 may allow users to calibrate printheads having a printhead die assembly with two printhead die. In particular, system 500 may allow users to minimize the variability of ink drop firing conditions in order to provide the desired image quality. Variations in ink drop size and velocity, and/or nominal nozzle positioning of different printheads may result in non-uniform output, grainy or noisy fill areas, and/or poor image quality. System 500 may allow users to separately calibrate the operating voltage of each of the printhead die in the printhead as well as an entire array of printheads.

System 500 may include processor 502 and memory 504. Processor 502 may include a single processing unit or distributed processing units configured to carry out instructions contained in memory 504. In general, following instructions contained in memory 504, processor 502 may allow users to separately calibrate the operating voltage of each printhead die as well as an entire array of printheads. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hardwired circuitry may be used in place of or in combination with software instructions to implement the functions described. For example, the functionality of system 500 may be implemented entirely or in part by one or more application-specific integrated circuits (ASICs). Unless otherwise specifically noted, system 500 is not limited to any specific combination of hardware circuitry and software, nor to any particular source for the instructions executed by the processing unit.

Figure 6:
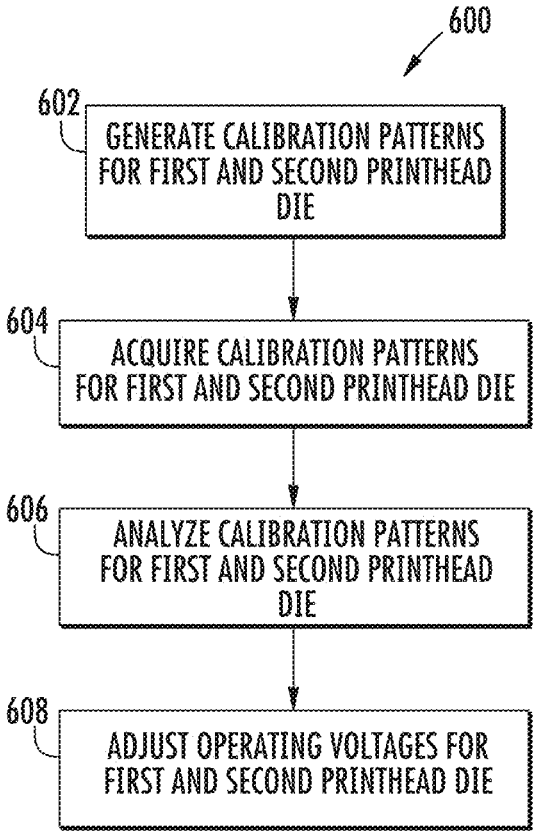
FIG. 6 is a flow diagram of an example method that may be carried out by the system of FIG. 5.

Memory 504 may include a non-transient computer-readable medium or other persistent storage device, volatile memory such as DRAM, or some combination of these; for example a hard disk combined with RAM. Memory 504 may contain instructions for directing the carrying out of functions and analysis by processor 502. In some implementations, memory 504 may further store data for use by processor 502. Memory 504 may store various software or code modules that direct processor 502 to carry out various interrelated actions. In the example illustrated, memory 504 includes a calibration pattern module 510, an acquisition module 520, an analysis module 530, and an adjustment module 540. In some examples, modules 510, 520, 530, and 540 may be combined or distributed into additional or fewer modules. Modules 510, 520, 530, and 540 may cooperate to direct processor 502 to carry out a method 600 set forth by the flow diagram of FIG. 6.

Figure 7:
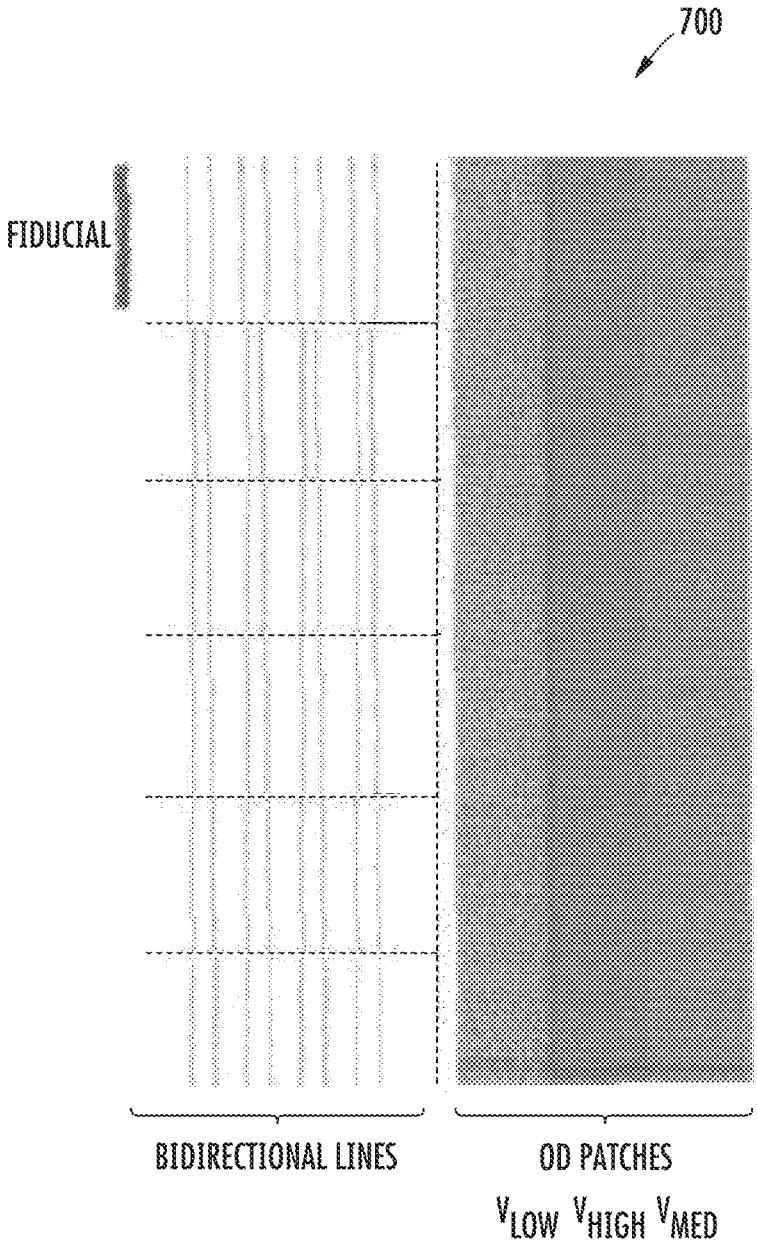
FIG. 7 is a diagram of an example printhead calibration pattern generated using the system of FIG. 5.

As indicated by a step 602, calibration patterns may be generated for each of two printhead die in a printhead by module 510. The calibration patterns may, for example, be printed by a printer in which the printhead is installed. FIG. 7 is a diagram illustrating an example printhead calibration pattern 700 generated using module 510. As shown in FIG. 7, multiple calibration patches may be generated for each printhead die by varying the operating voltage of each printhead die. Bidirectional lines may printed a various printing conditions, and a fiducial may indicate the print head side position and may be used to determine and calibrate errors.

Referring again to FIG. 6, as indicated by a step 604, the calibration patterns generated in step 602 for each printhead die may be acquired by acquisition module 520. For example, acquisition module 520 may direct processor 502 to scan the printed calibration patters into an electronic format that may be analyzed by system 500. As indicated by a step 606, the calibration patterns generated in step 602 for each printhead die may be analyzed by analysis module 530. For example, analysis module may analyze properties such as the physical distance between the two dies or nozzle column spacing, die tilt, die height, print axis velocity, target drop velocity, an offset from the target drop velocity, a nominal printing height, the distance it takes an ink drop to pass from ejection to substrate, etc.

As indicated by a step 608, operating voltages for each printhead die may be adjusted by adjustment module 540 based on the analysis in step 606. These adjustments may result in performance image quality improvements such as, for example, improved uniformity, more uniform drop weights, improved drop positioning, and correction of nozzle space errors, tilting, and die height differences.

While the embodiments of the invention have been illustrated and described, it will be appreciated that various changes can be made therein without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. One of skill in the art will understand that the invention may also be practiced without many of the details described above. Accordingly, it will be intended to include all such alternatives, modifications and variations set forth within the spirit and scope of the appended claims. Further, some well-known structures or functions may not be shown or described in detail because such structures or functions would be known to one skilled in the art. Unless a term is specifically and overtly defined in this specification, the terminology used in the present specification is intended to be interpreted in its broadest reasonable manner, even though may be used conjunction with the description of certain specific embodiments of the present invention.

What is claimed is:

1. A method for calibrating a printer, the method comprising:

positioning a first printhead die and a second printhead die back-to-back within a die carrier;

using a registration pin of the die carrier as a reference point to align nozzles of the first printhead die and the second printhead die such that centers of the nozzles of the first printhead die are spaced a first distance from the reference point provided by the registration pin and such that centers of the nozzles of the second printhead die are offset from the nozzles of the first printhead die, the nozzles of the second printhead die being spaced a second distance, different than the first distance, from the reference point provided by the registration pin; and fixing the position of the first printhead die and the second printhead die within the die carrier, wherein the nozzles of the first printhead die and the second printed die face in a first direction, wherein the first printhead die and the second printhead die have abutting faces extending in first and second parallel planes and wherein the registration pin extends along an axis parallel to the first direction and parallel to the first and second parallel planes, the registration pin being intersected by the first and second parallel planes.

2. The method of claim 1, wherein fixing the position of the first printhead die and the second printhead die within the die carrier includes applying an adhesive to the first printhead die, the second printhead die and the die carrier.

3. The method of claim 1, further comprising applying a layer of adhesive between the first and second printhead die.

4. The method of claim 1, wherein the first printhead die and the second printhead die are aligned by:

acquiring a position of each of the first and second printhead die relative to the registration pin using an optics tool that carries out image processing; and controlling movement of a motorized stage coupled to a micro gripper based upon the acquired position of each of the first and second printhead die relative to the registration pin.

5. The method of claim 1, wherein the first printhead die and the second printhead die are manufactured from a silicon wafer.

6. The method of claim 1, wherein the die carrier provides electrical and fluidic connections to the first printhead die and the second printhead die.

* * * * *